US006347974B1

(12) United States Patent
Chandler et al.

(10) Patent No.: US 6,347,974 B1
(45) Date of Patent: Feb. 19, 2002

(54) AUTOMATED POLISHING METHODS

(76) Inventors: William Keith Chandler, 202 Autumn Sky Ter., Woodsboro, MA (US) 21798; Nadir Shah, 6827 Old Waterloo Rd., Apt. 1106, Elkridge, MD (US) 21075

( * ) Notice: Subject to any disclaimer, the term of this patent is extended or adjusted under 35 U.S.C. 154(b) by 0 days.

(21) Appl. No.: 09/426,997

(22) Filed: Oct. 26, 1999

(51) Int. Cl.[7] ..... B25B 49/00
(52) U.S. Cl. ..... 451/5; 451/41
(58) Field of Search ..... 451/5, 11, 12, 451/41, 42, 384, 390

(56) References Cited

U.S. PATENT DOCUMENTS 5,007,209 A * 4/1991 Saito ..... 451/41
5,480,344 A * 1/1996 Xu ..... 451/41
5,667,426 A * 9/1997 Minami ..... 451/41
5,743,787 A * 4/1998 Ishiyama ..... 451/41
5,855,503 A * 1/1999 Cspikes ..... 451/41
6,106,368 A * 8/2000 Childers ..... 451/41
6,113,469 A * 9/2000 Yoshikawa ..... 451/41
6,165,055 A * 12/2000 Takahashi ..... 451/41
6,261,151 B1 * 7/2001 Sandhu ..... 451/5

* cited by examiner

*Primary Examiner*—Derris H. Banks
*Assistant Examiner*—Daniel Shanley
(74) *Attorney, Agent, or Firm*—David L. Soltz; Micheal R. Cammarata

(57) ABSTRACT

A controller sets polishing parameters and automatically supplies materials needed for polishing to a polishing unit in accordance with a type of connector to be polished. The controller may also control the duration and pressure applied during polishing. Washing and any repeating of polishing may also be automated. Once polishing is complete, the connector may be inspected to determine if it has been satisfactorily polished. If not, the polishing parameters may be altered and the connector is repolished and reinspected.

16 Claims, 4 Drawing Sheets

AUTOMATED POLISHING METHODS

BACKGROUND OF THE INVENTION

1. Field of the Invention

The present invention is directed to an apparatus for polishing a variety of connectors in an automated fashion, and the methods associated therewith.

2. Description of the Related Art

Fiber connecterization is the process of bonding an optical fiber within a fiber optic connector. The resulting connection must provide a smooth optical interface with controlled geometry parameters and mechanical specifications. Currently, the fiber connecterization process is mostly manual, with the quality of the connectorized fiber depending upon the skill of the operator. Recent developments in fiber optic communication systems have increased the demand for low cost, high performance connectors.

One important parameter for insuring high performance is the smoothness of the interface surface. A polisher is used to transform a rough connector optical interface into a smooth interface to insure proper connection between the fiber and the connector. Such polishing is typically an iterative and sensitive process and is performed in accordance with an operator=s subjective selection of a set of parameters. Further, once these parameters are set by the user, there is no insurance that the polishing machine will operate within the input parameters.

SUMMARY OF THE INVENTION

The present invention is therefore directed to an apparatus for automated polishing of optical fibers and the methods associated therewith which substantially overcomes one or more of the problems due to the limitations and disadvantages of the related art.

The above and other objects may be realized by a system for automatically polishing a connector including a polishing media supply, a polishing unit receiving polishing media from the polishing media supply, and a controller for determining a polishing media to be provided by the polishing media supply in accordance with a type of connector to be polished and automatically providing a determined polishing media to the polishing unit.

The polishing media supply may include a polishing fluid supply which supplies a polishing fluid to the polishing unit and/or a lapping film supply which supplies a lapping film to the polishing unit, and the controller determines a polishing fluid and a lapping film to be provided in accordance with a type of connector to be polished and automatically providing a determined polishing fluid and lapping film to the polishing unit. The controller may further regulate a duration and a pressure of polishing by the polishing unit. The controller may determine the polishing media from a look-up table.

The system may include a test unit for evaluating the connectors polished by the polishing unit and, if connectors are not satisfactory, altering the polishing parameters determined by the controller.

The system may include a washing unit for cleaning the connectors after being polished in the polishing unit, the controller further setting the parameters for the washing unit. The system may include an arm for transporting the connectors between the polishing unit and the washing unit.

The above and other objects may also be realized by a method for automatically polishing a connector including determining a type of connector to be polished, setting polishing parameters in accordance with the type of connector, and automatically performing polishing using polishing parameters established by the setting.

The polishing may include automatically supplying a polishing fluid and a lapping film set to a polishing unit. The setting may include looking up polishing parameters for the type of connector in a predetermined table.

The method may include testing connectors after completing polishing in accordance with said polishing parameters, altering said polishing parameters if said testing indicates polished connectors are not satisfactory, polishing connectors in accordance with altered polishing parameters, and if polishing with the altered polishing parameters results in the testing indicating connectors are satisfactory, updating the polishing parameters in the look-up table.

The method may include cleaning connectors after polishing. The method may include automatically repeating polishing and cleaning a plurality of times. The cleaning may be performed in accordance with parameters set by the setting.

The above and other object may be realized by providing a method for automatically polishing a fiber including determining a type of connector to be used with the fiber, setting polishing parameters in accordance with the type of connector, and performing polishing using polishing parameters established by the setting.

The above and other objects may be realized by a system for connecterization processing including a preparation station for forming the connector, an automated polishing station for automatically polishing the connector, and a test station for determining acceptability of polished connectors.

The preparation station and the test station may be integrated on a single platform. There may be at least two preparation stations and/or at least two test stations.

The above and other objects of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and other objects, aspects and advantages will be described with reference to the drawings, in which.

DETAILED DESCRIPTION OF THE PREFERRED EMBODIMENTS

While the present invention involves an automated polishing unit, a description of the preparation and inspection/ test units is provided to present the overall system and the interrelationships between the units. Further, since use of an automatic polishing unit in accordance with the present invention will increase the speed of the polishing process, use of the automatic polishing unit may result in new configurations of the overall system.

Figure 1:
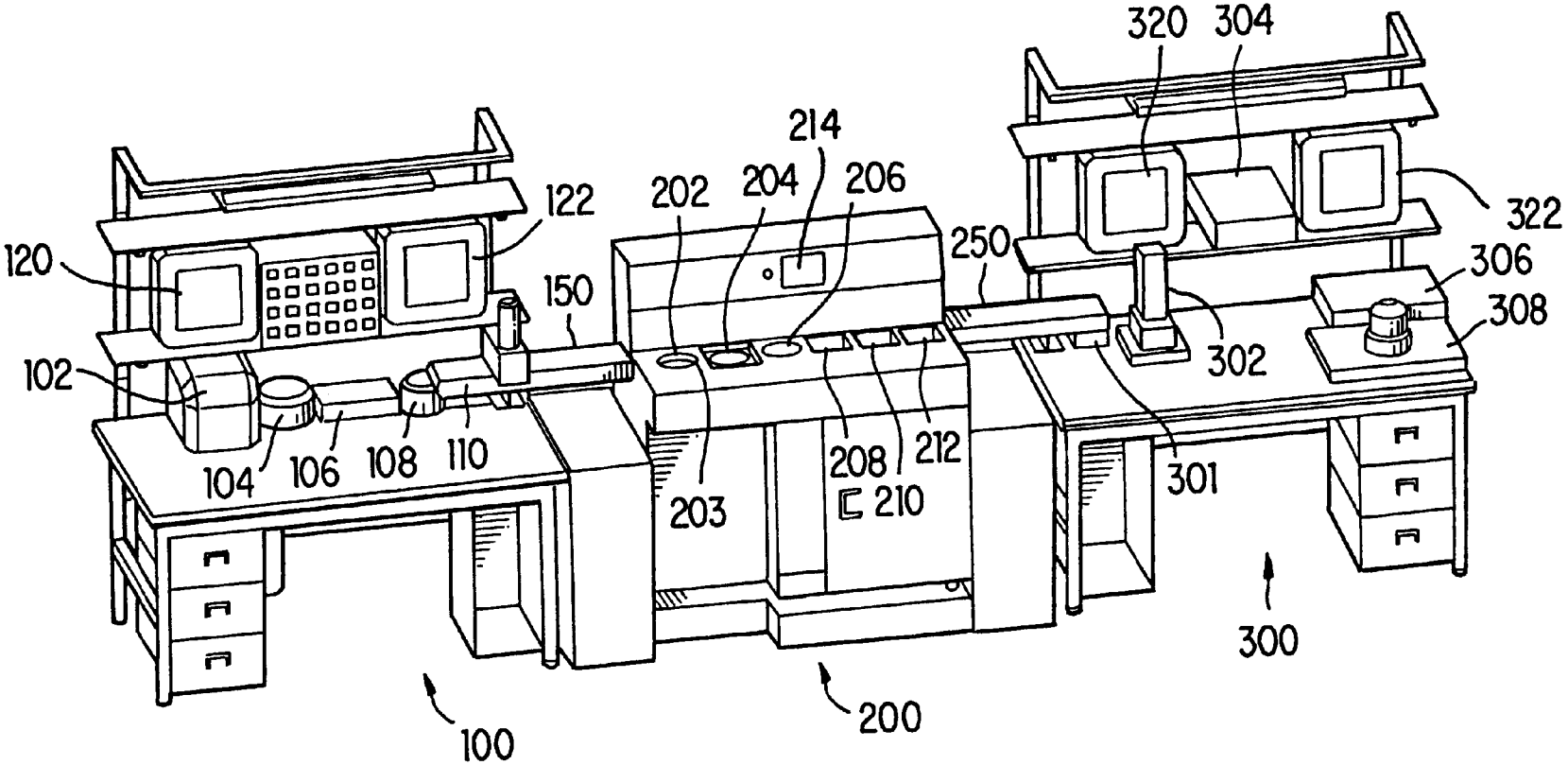
FIG. 1 is a schematic elevational front perspective view of three stations for fiber connectorization processing.

The three stages of the connecterization process are shown as separate stations in FIG. 1. A preparation station 100 includes equipment for performing numerous processes for preparing the connector. A polish station 200 changes the rough connector optical interfaces from the preparation station 100 into interfaces with a smooth surface with controlled geometry parameters. A testing station 300 includes equipment for a series of tests to make sure the resultant connector from the polish station 200 is satisfactory.

As shown in FIG. 1, the preparation station 100 may include a cable preparation unit 102, a ferrule sizing unit 104, an adhesive application unit 106, an adhesive curing unit 108 and adhesive removal unit 110. A cable may by either a bare fiber or a fiber in a housing, such as a ferrule. The units of the preparation station respectively insure that the cable is prepared for insertion, determines the size of the hole into which the cable is to be inserted, prepares and applies adhesive to connector and/or cable, including inserting the cable into the connector, hardens or cures the adhesive, and removes any excess adhesive, particularly from the end of the cable. Monitors 120, 122 provide visual inspection of the processing and /or instructions to a user.

A transport mechanism 150, 152 transports the prepared cable/connector to the polish station 200. The polish station 200 shown in FIG. 1 includes a washing unit 202, a polishing unit 204, a lapping film stager 206, a plurality, e.g., three, disposal tanks 208–212, and a data control panel 214. An air blower 203 is between the washing unit 202 and the polishing unit 204.

Figure 4:
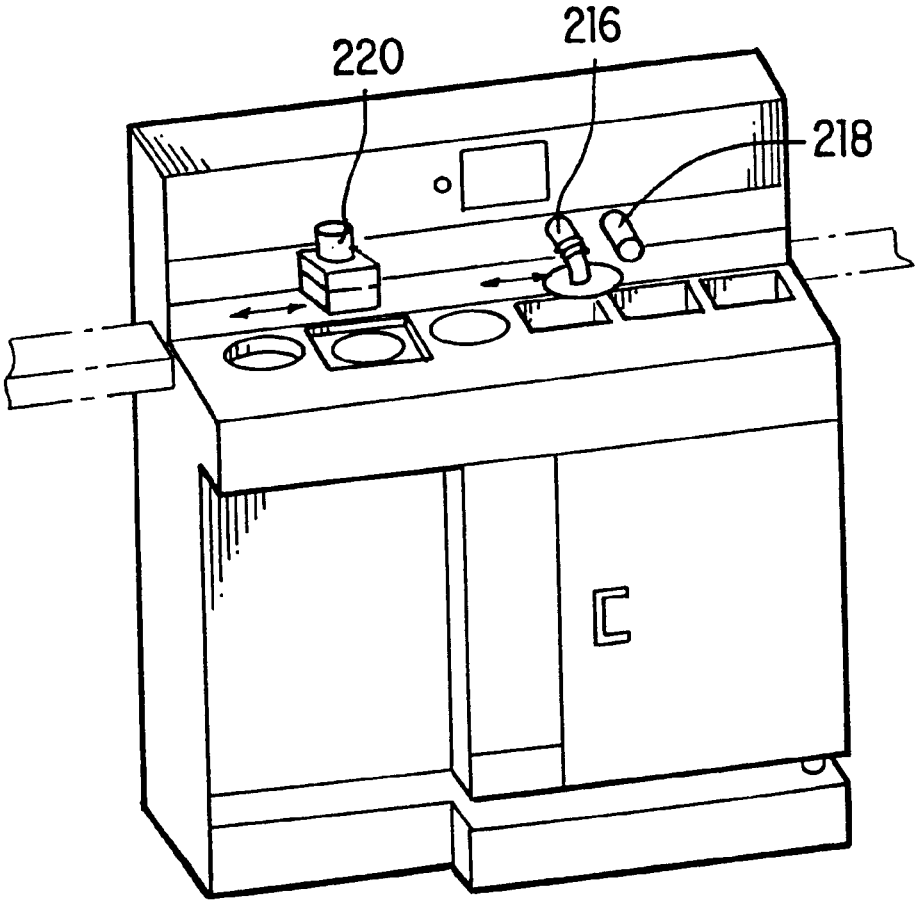
FIG. 4 is a detailed schematic elevational perspective side view of the automated polisher.

A first lapping film is supplied from the lapping film stager 206 to the polishing unit 204 via a lapping film transport arm 216, shown in FIG. 4. When the lapping film to be used and the connector to be polished are positioned on the polishing unit 204, an appropriate slurry will be supplied via a feed 218. The feed 218 preferably has multiple passages for supplying different types of slurry or other types of polishing fluids and/or washing fluids. The polishing unit 204 oscillates the lapping film to provide the polishing action. The slurry, the lapping film, the rotations per minute of the wheel and the applied pressure are all automatically controlled in accordance with the parameters set by the data control panel 214.

In accordance with a preferred embodiment of the present invention, a plurality of connectors to be polished are inserted onto a jig 220, shown in FIG. 4, which holds the ends so that they will maintain surface contact with the lapping film on the polishing unit 204. Of course, a single connector may be polished at a time. The jig 220 is pressed against the polishing surface at a specified pressure and the wheel rotates at a specified rate. Currently, the plurality of connectors are manually removed from the transport mechanism 150 and inserted into the jig 220. The details of a preferred embodiment of the jig 220 are set forth in commonly assigned, co-pending application Ser. No. 09/031,816 entitled AApparatus and Method for Calibrating Pressure Applied to Optical Fibers During Polishing Process @ filed Aug. 4, 1998, the entire contents of which are hereby incorporated by reference for all purposes. The jig is preferably mounted on the same groove as the transport mechanisms.

When the polishing is complete, the connectors in the jig 220 are transported to the washing unit 202 and washing fluid is supplied, for example, by the feed 218. Here, the connectors are washed for specified cycles to rinse any residual slurry and/or polished particles from the connectors. The washed connectors are then dried with the air blower 203. Movement of the jig 220 from the polishing unit 204 to the washing unit 202 and the air blower 203, as well as the washing cycles, may also be controlled by the data control panel 214.

Often, more than one polishing sequence is required. The lapping film on the polishing unit 204 may be disposed of in one of a number, e.g., three, disposal tanks 208–212. Another lapping film from the lapping film stocker 206 may then be supplied to the wheel of the polishing unit 204 via the arm 216. The above sequence of film supplying, polishing and rinsing may be repeated any number of desired times.

While the polishing parameters may be entered by a user, a look-up table for prescribing polishing parameters, including polishing conditions of type of lapping film, type of slurry, polishing pressure, polishing time, polishing unit rotations per minute, timing of slurry supply, number and type of cycles, etc., and washing conditions of washing pressure, time of washing fluid supply, number of cycles, priority, etc. The look-up table for setting the polishing parameters may be established by polishing and washing the connectors with a set of parameters, testing the connectors, and modifying the polishing parameters until acceptable test results are achieved. The polishing parameters may be overridden by a user input, while still taking advantage of automatic control of the operation of the polishing unit to insure that the polishing is performed within the prescribed parameters.

Once the polishing is complete, the connectors are transported via the transport mechanism 250 to the test station 300. Currently, the connectors are manually removed from the jig, inserted and clamped into the transport mechanism 250. As shown in FIG. 1, the test station 300 may include a visual inspection station 302, including a light source 301, a power meter 304, an optical measurement tester 306 and a ferrule geometry tester 308. If the results of the testing are not satisfactory, the polishing parameters may be altered, the connectors re-polished by the polishing station 200 and then re-tested by the testing station 300. Monitors 320,322 provide an image of the connector, test results to an operator and/or instructions to an operator. The specific tests and requirements for a connector to be found satisfactory by the test station 300 will depend on the type of connector. The alteration of the polishing parameters, the re-polishing, and the re-testing may all occur at some later time(s).

Figure 2:
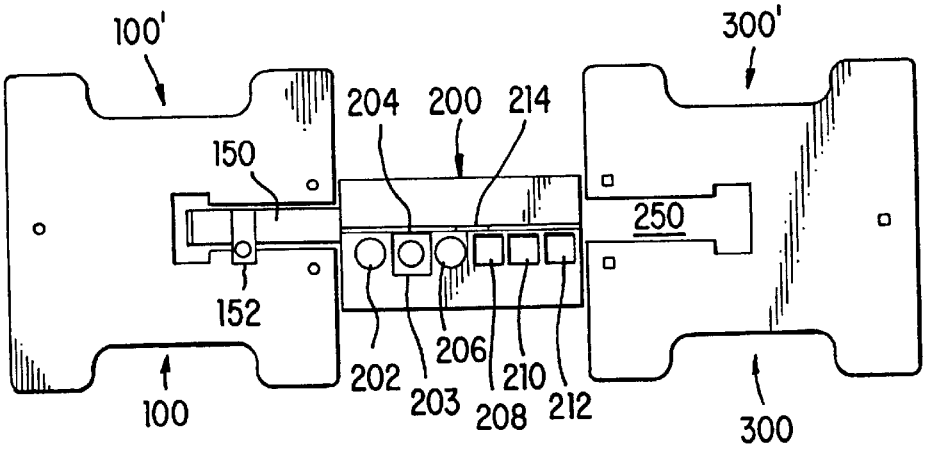
FIG. 2 is a schematic top view of two sets of stations shown in FIG. 1, positioned back to-back, with a single polishing station.
Figure 3:
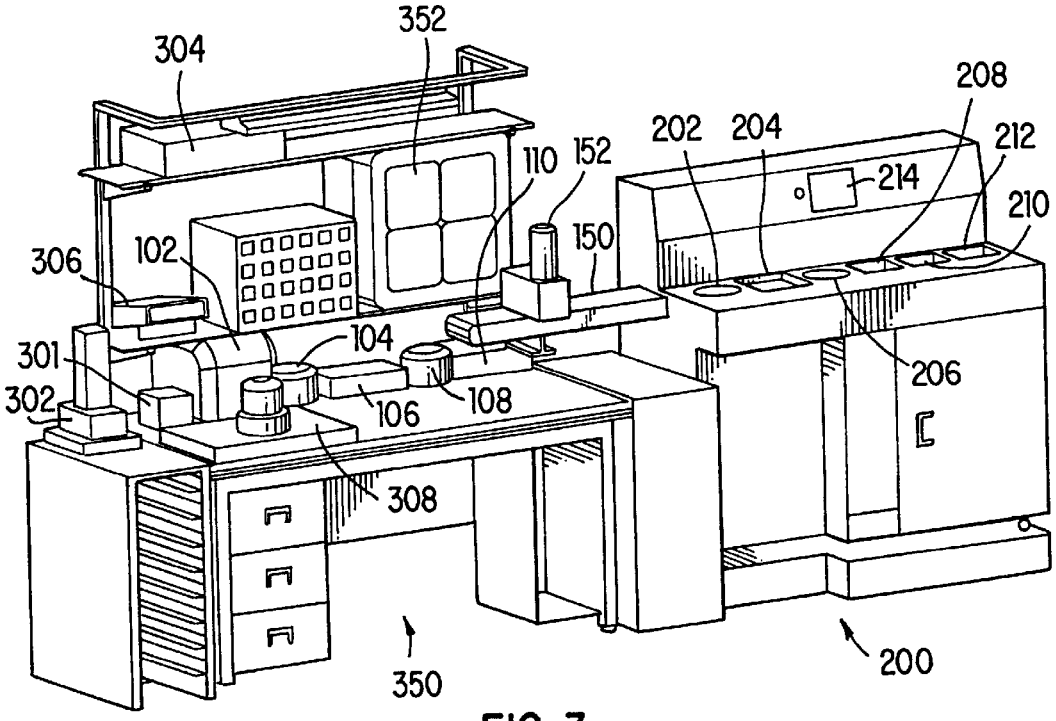
FIG. 3 is a schematic elevational front view of stations for connecterization processing, with the prepping and testing stations being integrated together.

FIGS. 2 and 3 illustrate alternative embodiments of the connector assembly of the present invention. In FIG. 2, a plurality, e.g., two, of preparation stations 100, 100' and test stations 300, 300' are provided at a single polish station 200. Typically, the polishing requires less time to complete than the preparation or the testing. This difference in processing times is even more pronounced when using the jig in accordance with the preferred embodiment in which multiple connectors are polished simultaneously. Thus, multiple preparation and/or test stations can more fully utilize the polish station 200. While FIG. 2 illustrates using the same number of preparation stations 100, 100' and test stations 200, 200', these stations do not have to be of the same number, but may be allocated in accordance with their respective processing times.

FIG. 3 illustrates a configuration in which the preparation station 100 and the test station 300 are integrated as a preparation/test station 350 to occupy the same space. The respective units of these two stations may be positioned as illustrated in FIG. 3. The units of the stations are still preferably adjacent to one another as positioned in their respective separate stations. Further space saving may be realized by providing a single monitor 352 having a split screen to supply all of the images previously displayed on monitors 120, 122, 320, 322 to the user at a single location.

Figure 5:
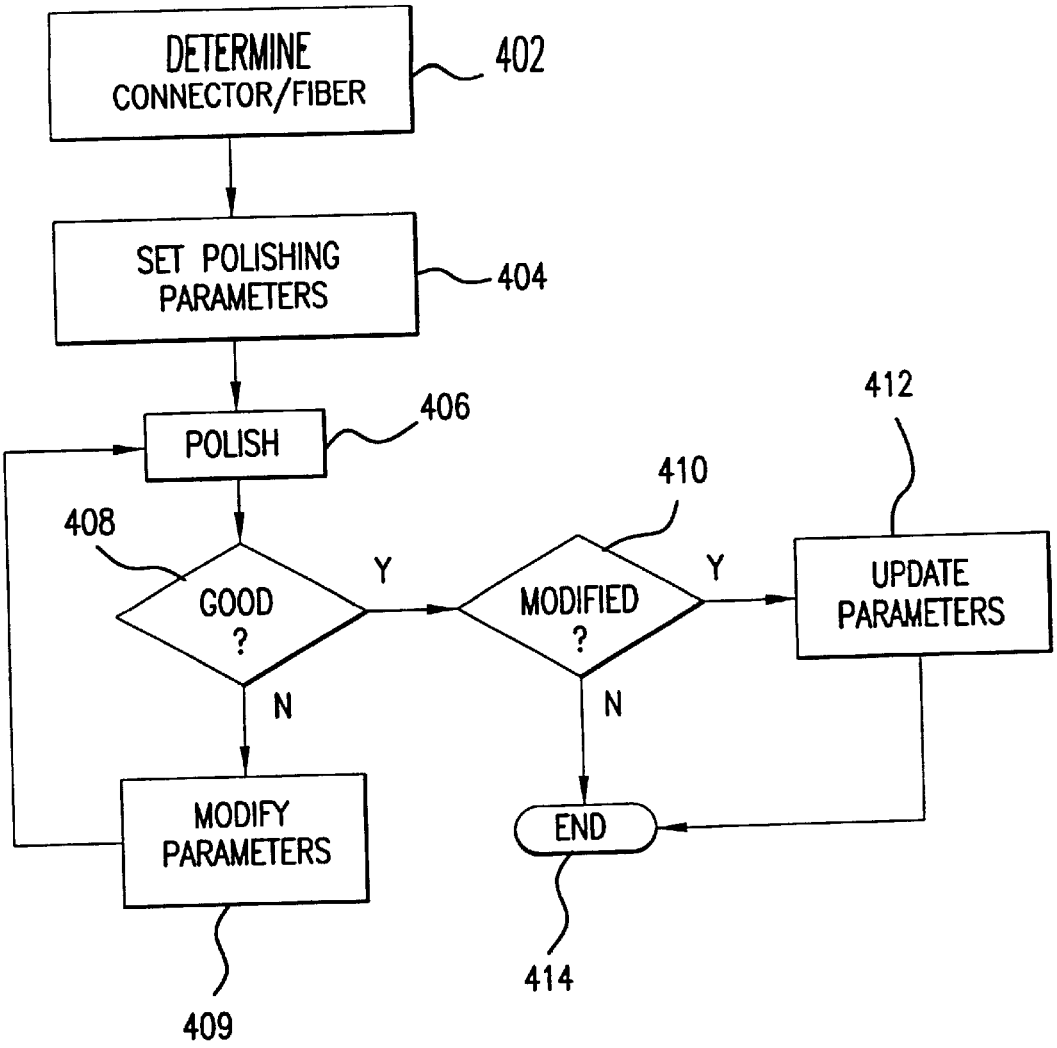
FIG. 5 is a flow chart for initializing and/or updating the polishing parameters associated with a particular connector.

A flow chart illustrating a method for establishing/updating polishing parameters is shown in FIG. 5. First, in 402, the type of connector is determined. In 404, polishing parameters are set. When establishing the look-up table, these polishing parameters are preferably initialized by an experienced polisher. When updating a created look-up table, these polishing parameters are those stored for the connector type.

In 406, the connector is polished, including washing and any multiple passes with the polishing unit, in accordance with the set polishing parameters. In 408, the connector is tested. If the test indicates the connector is satisfactory or good, in 410 it is determined whether the polishing parameters had been modified. If not, the process ends at 414. If so, the polishing parameters are updated in the look-up table in 412, preferably according to some weighting scheme to account for the number of times the initial polishing parameters had resulted in a satisfactory connector.

If the test in 408 indicates the connector is no good, the polishing parameters may be modified in 409. Then the process returns to 406 to have the connector re-polished and the test 408 re-run.

Thus, the use of such a look-up table may provide optimum objective polishing parameters for use with any polisher, rather than relying on subjective user supplied polishing parameters.

The automated polishing of the present invention increases throughput, yields, and consistency by reducing manual operations, automatically controlling the polishing process and/or automatically setting the polishing parameters.

While the present invention is described herein with reference to illustrative embodiments for particular applications, it should be understood that the present invention is not limited thereto. Those having ordinary skill in the art and access to the teachings provided herein will recognize additional modifications, applications, and embodiments within the scope thereof and additional fields in which the invention would be of significant utility without undue experimentation. Thus, the scope of the invention should be determined by the appended claims and their legal equivalents, rather than by the examples given.

What is claimed is:

1. A method for automatically polishing a connector comprising:

determining a type of connector to be polished;

setting polishing parameters in accordance with the type of connector; and automatically performing polishing using polishing parameters established by the setting, wherein the polishing parameters include a type of lapping film, a type of slurry, a polishing pressure, a polishing time, a number of polishing unit rotations per minute, a timing of slurry supply, a number of polishing cycles, or a type of polishing cycle.

2. The method of claim 1, wherein said performing polishing includes automatically supplying a polishing fluid and a lapping film set by said setting to a polishing unit.

3. The method of claim 1, wherein said setting includes looking up polishing parameters for the type of connector in a look-up table.

4. The method of claim 3, further comprising:

testing said connector after completing polishing in accordance with said polishing parameters, altering said polishing parameters if said testing indicates said polished connector is not satisfactory, repolishing said connector in accordance with said altered polishing parameters, and if repolishing with said altered polishing parameters results in said testing indicating that said repolished connector is satisfactory, updating said polishing parameters in the look-up table.

5. The method of claim 1, further comprising cleaning connectors after said polishing.

6. The method of claim 5, further comprising automatically repeating said polishing and cleaning a plurality of times.

7. The method of claim 5, wherein said cleaning is performed in accordance with parameters set by said setting.

8. The method of claim 1, wherein the polishing parameters include polishing conditions.

9. The method of claim 1, wherein the polishing parameters include washing conditions.

10. The method of claim 1, wherein the polishing parameters include a washing pressure, a time of washing fluid supply, a number of washing cycles, or a priority.

11. The method of claim 1, wherein the polishing parameters include polishing conditions and washing conditions.

12. A method for automatically polishing a fiber comprising:

determining a type of connector to be used with the fiber;

setting polishing parameters in accordance with the type of connector; and automatically performing polishing of the fiber using polishing parameters established by the setting, wherein the polishing parameters include a type of lapping film, a type of slurry, a polishing pressure, a polishing time, a number of polishing unit rotations per minute, a timing of slurry supply, a number of polishing cycles, or a type of polishing cycle.

13. The method of claim 3, further comprising:

testing said connector after completing polishing in accordance with said polishing parameters, and altering said polishing parameters based on results of said testing.

14. The method of claim 12, further comprising:

testing said polished fiber after completing polishing in accordance with said polishing parameters, and altering said polishing parameters based on results of said testing.

15. The method of claim 12, wherein said setting includes looking up polishing parameters for the type of connector in a look-up table.

16. The method of claim 15, further comprising:

testing said connector after completing polishing in accordance with said polishing parameters, altering said polishing parameters if said testing indicates said polished connector is not satisfactory, repolishing said connector in accordance with said altered polishing parameters, and if repolishing with said altered polishing parameters results in said testing indicating that said repolished connector is satisfactory, updating said polishing parameters in the look-up table.

* * * * *